US011788525B2

(12) United States Patent
Delmotte

(10) Patent No.: US 11,788,525 B2
(45) Date of Patent: Oct. 17, 2023

(54) RECIPROCATING COMPRESSOR VALVE ASSEMBLY

(71) Applicant: SIEMENS ENERGY, INC., Orlando, FL (US)

(72) Inventor: Scott J. Delmotte, Mansfield, PA (US)

(73) Assignee: SIEMENS ENERGY, INC., Orlando, FL (US)

( * ) Notice: Subject to any disclaimer, the term of this patent is extended or adjusted under 35 U.S.C. 154(b) by 0 days.

(21) Appl. No.: 17/777,062

(22) PCT Filed: Dec. 19, 2019

(86) PCT No.: PCT/US2019/067507

§ 371 (c)(1),
(2) Date: May 16, 2022

(87) PCT Pub. No.: WO2021/126212

PCT Pub. Date: Jun. 24, 2021

(65) Prior Publication Data

US 2022/0403834 A1 Dec. 22, 2022

(51) Int. Cl.
*F04B 39/10* (2006.01)
*F04B 5/02* (2006.01)
(Continued)

(52) U.S. Cl.
CPC ..... *F04B 39/10* (2013.01); *F04B 5/02* (2013.01); *F04B 39/123* (2013.01); *F04B 53/10* (2013.01); *F04B 53/22* (2013.01)

(58) Field of Classification Search
CPC ..... F04B 39/10; F04B 5/02; F04B 39/123; F04B 53/10; F04B 53/22; F16K 15/06; F16K 15/066; F16K 15/063
See application file for complete search history.

(56) References Cited

U.S. PATENT DOCUMENTS 1,331,233 A 2/1920 Bery
1,334,073 A * 3/1920 Bery ..... F04B 39/1013 137/542

(Continued)

FOREIGN PATENT DOCUMENTS

WO 2019058221 A1 3/2019

OTHER PUBLICATIONS

PCT International Search Report and Written Opinion of International Searching Authority dated Mar. 19, 2020 corresponding to PCT International Application No. PCT/US2019/067507 filed Dec. 19, 2019.

*Primary Examiner* — Nathan C Zollinger

(57) ABSTRACT

A reciprocating compressor includes a compressor cylinder defining a cylinder wall, a valve bore formed in the cylinder wall, and a compressor valve assembly arranged in the compressor cylinder. The compressor valve assembly includes a valve liner having a liner body and a liner flange disposed at an end of the liner body. The liner body is disposed in the valve bore. The liner flange is positioned in contact with the compressor cylinder. A valve seat is coupled to an inner surface of the liner body. The valve seat has a seating surface formed at an end of the valve seat. A compressor valve is positioned on the seating surface of the valve seat. A valve cage is positioned on the compressor valve. A valve cover is coupled to the valve cage to apply a bias force to retain the compressor valve on the seating surface of the valve seat.

26 Claims, 7 Drawing Sheets

(51) Int. Cl.

| | |
|---|---|
| ***F04B 39/12*** | (2006.01) |
| ***F04B 53/10*** | (2006.01) |
| ***F04B 53/22*** | (2006.01) |

(56) References Cited

U.S. PATENT DOCUMENTS

| | | | | |
|---|---|---|---|---|
| 1,490,141 | A | 4/1924 | Morris | |
| 3,518,032 | A * | 6/1970 | Degroff | F04B 49/24 251/324 |
| 4,618,316 | A * | 10/1986 | Elliott | F04B 53/103 417/454 |
| 5,947,697 | A | 9/1999 | Morrison | |
| 6,190,144 | B1 | 2/2001 | Balma | |
| 9,103,335 | B2 | 8/2015 | Mohamed | |
| 2005/0229975 | A1* | 10/2005 | Moe | F04B 53/109 137/454.4 |
| 2012/0107144 | A1 | 5/2012 | Keifer | |
| 2019/0186478 | A1 | 6/2019 | Cappelli et al. | |

* cited by examiner

RECIPROCATING COMPRESSOR VALVE ASSEMBLY

BACKGROUND

A reciprocating compressor is a positive displacement compressor. In a reciprocating compressor, a fluid to be compressed enters a chamber via an inlet and exits the chamber through an outlet. The compression is a cyclical process in which the fluid is compressed by a reciprocating movement of a piston head. A plurality of compressor valve assemblies may be arranged around the chamber. The compressor valve assemblies are switched between a close state and an open state due to a pressure difference across the compressor valve assemblies which is caused by the reciprocating movements of the piston head.

In a reciprocating compressor, performance and reliability of a compressor valve assembly are key to a performance of the reciprocating compressor. There is a continuing need for a more efficient and reliable compressor valve assembly for a reciprocating compressor.

BRIEF SUMMARY

A reciprocating compressor is presented. The reciprocating compressor comprises a compressor cylinder defining a cylinder wall. The reciprocating compressor comprises a valve bore formed in the cylinder wall. The reciprocating compressor comprises a compressor valve assembly arranged in the compressor cylinder. The compressor valve assembly comprises a valve liner comprising a liner body and a liner flange disposed at a first end of the liner body. The liner body is disposed in the valve bore and comprising a liner window. The liner flange is positioned in contact with the compressor cylinder. A valve seat is coupled to an inner surface of the liner body. The valve seat comprises a seating surface formed at an end of the valve seat. The compressor valve assembly comprises a compressor valve positioned on the seating surface of the valve seat. The compressor valve assembly comprises a valve cage positioned on the compressor valve. The valve cage comprises a cage window. The compressor valve assembly comprises a valve cover coupled to the valve cage to apply a bias force to retain the compressor valve on the seating surface of the valve seat.

A method for assembling a reciprocating compressor is presented. The reciprocating compressor comprises a compressor cylinder. The method comprises positioning a valve liner in a valve bore formed in a cylinder wall of the compressor cylinder. The valve liner comprises a liner body, a liner window formed in the liner body, a valve seat coupled to an inner surface of the liner body, and a liner flange disposed at a first end of the liner body, the liner flange in contact with the compressor cylinder, the valve seat comprising a seating surface formed at an end of the valve seat. The method comprises installing a compressor valve in the liner body, the compressor valve in contact with the seating surface of the valve seat. The method comprises positioning a valve cage on the compressor valve, the valve cage comprising a cage window. The method comprises circumferentially aligning the cage window with the liner window. The method comprises coupling a valve cover to the valve cage to apply a bias force to retain the compressor valve on the seating surface of the valve seat.

A compressor valve assembly is presented. The compressor valve assembly is to be arranged in a compressor cylinder of a reciprocating compressor. The compressor valve assembly comprises a valve liner comprising a liner body and a liner flange disposed at a first end of the liner body, the liner body comprising a liner window, a valve seat coupled to an inner surface of the liner body, the valve seat comprising a seating surface formed at an end of the valve seat. The compressor valve assembly comprises a compressor valve positioned on the seating surface of the valve seat. The compressor valve assembly comprises a valve cage positioned on the compressor valve, the valve cage comprising a cage window. The compressor valve assembly comprises a valve cover coupled to the valve cage to apply a bias force to retain the compressor valve on the seating surface of the valve seat.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Figure 1:
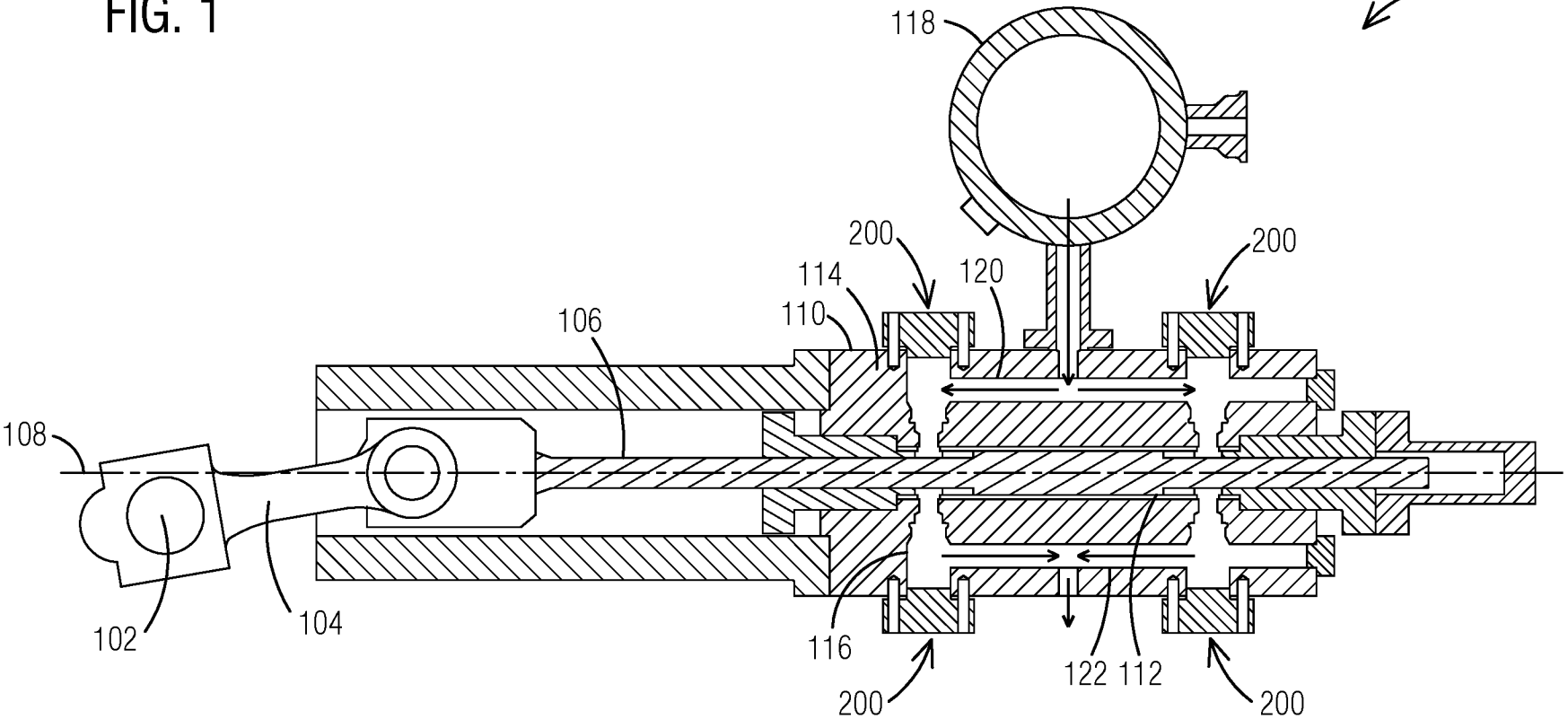
FIG. 1 illustrates a schematic longitudinal cross-section view of a reciprocating compressor.

Before any embodiments of the invention are explained in detail, it is to be understood that the invention is not limited in its application to the details of construction and the arrangement of components set forth in this description or illustrated in the following drawings. The invention is capable of other embodiments and of being practiced or of being carried out in various ways. Also, it is to be understood that the phraseology and terminology used herein is for the purpose of description and should not be regarded as limiting.

Various technologies that pertain to apparatus and methods will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus.

It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

Also, it should be understood that the words or phrases used herein should be construed broadly, unless expressly limited in some examples. For example, the terms "including," "having," and "comprising," as well as derivatives thereof, mean inclusion without limitation. The singular forms "a", "an" and "the" are intended to include the plural forms as well, unless the context clearly indicates otherwise. Further, the term "and/or" as used herein refers to and encompasses any and all possible combinations of one or more of the associated listed items. The term "or" is inclusive, meaning and/or, unless the context clearly indicates otherwise. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Furthermore, while multiple embodiments or constructions may be described herein, any features, methods, steps, components, etc. described with regard to one embodiment are equally applicable to other embodiments absent a specific statement to the contrary.

Also, although the terms "first", "second", "third" and so forth may be used herein to refer to various elements, information, functions, or acts, these elements, information, functions, or acts should not be limited by these terms. Rather these numeral adjectives are used to distinguish different elements, information, functions or acts from each other. For example, a first element, information, function, or act could be termed a second element, information, function, or act, and, similarly, a second element, information, function, or act could be termed a first element, information, function, or act, without departing from the scope of the present disclosure.

Also, unless specified or limited otherwise, the terms "mounted", "connected", "supported", and "coupled" and variations thereof are used broadly and encompass direct and indirect mountings, connections, supports, and couplings. Further, "connected" and "coupled" are not restricted to physical or mechanical connections or couplings.

In addition, the term "adjacent to" may mean: that an element is relatively near to but not in contact with a further element; or that the element is in contact with the further portion, unless the context clearly indicates otherwise. Further, the phrase "based on" is intended to mean "based, at least in part, on" unless explicitly stated otherwise. Terms "about" or "substantially" or like terms are intended to cover variations in a value that are within normal industry manufacturing tolerances for that dimension. If no industry standard as available a variation of 20 percent would fall within the meaning of these terms unless otherwise stated.

FIG. 1 illustrates a schematic longitudinal cross-section view of a reciprocating compressor 100 including a crankshaft 102 connected to a driving rod 104. The driving rod 104 is connected to a piston rod 106. The piston rod 106 extends longitudinally along a longitudinal axis 108 into a compressor cylinder 110. The compressor cylinder 110 includes a cylinder bore 112. The piston rod 106 is at least partially disposed within the cylinder bore 112. The piston rod 106 is driven by the driving rod 104 and moves within the cylinder bore 112 in a reciprocating manner along the longitudinal axis 108 as indicated by the dual arrow line.

The compressor cylinder 110 includes a cylinder wall 114 through which a valve bore 116 extends. A compressor valve assembly 200 is disposed in the valve bore 116. The reciprocating compressor 100 includes more than one compressor valve assembly 200 disposed in more than one valve bore 116, respectively. The reciprocating compressor 100 includes a fluid supply device 118. The fluid supply device 118 is in fluid communication with the compressor valve assembly 200 via a fluid inlet passage 120.

In operation of the reciprocating compressor 100, the compressor valve assembly 200 is switched between an open state and a closed state due to the reciprocating movements of the piston rod 106 to control fluid to be compressed entering the compressor cylinder 110 via the fluid inlet passage 120 and exiting the compressor cylinder 110 via a fluid discharge passage 122.

Figure 2:
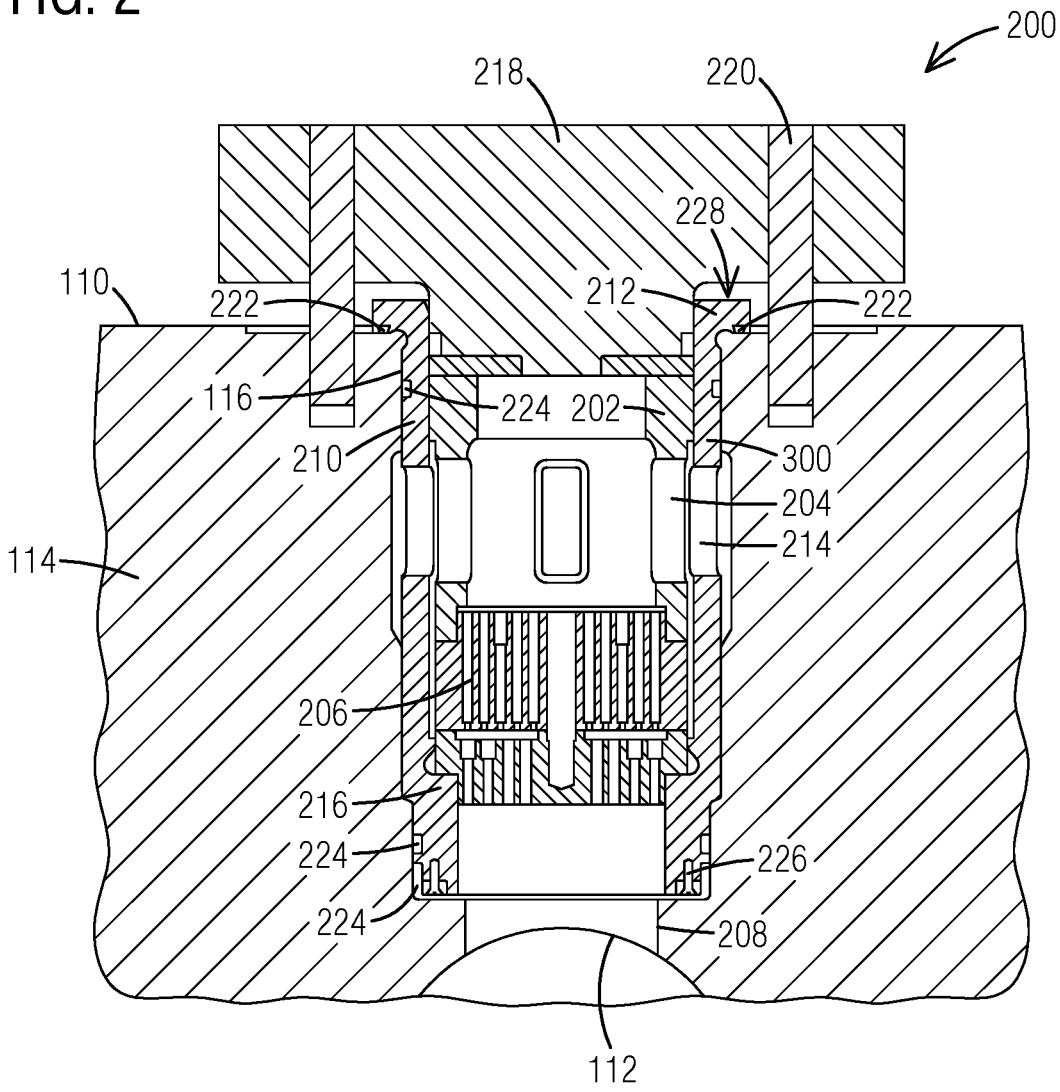
FIG. 2 illustrates a schematic section view of a compressor valve assembly for use with the reciprocating compressor of FIG. 1.

FIG. 2 illustrates a schematic end view of the compressor valve assembly 200 assembled in the compressor cylinder 110 of the reciprocating compressor 100. The compressor valve assembly 200 includes a valve cage 202 and a compressor valve 206. The valve cage 202 and the compressor valve 206 are disposed in the valve bore 116 and stacked adjacent each other. The valve cage 202 has a generally hollow cylindrical shape. The valve cage 202 includes a cage window 204. The compressor valve assembly 200 includes a valve passage 208 disposed between the compressor valve 206 and the cylinder bore 112.

The compressor valve assembly 200 also includes a valve liner 300 arranged in the compressor cylinder 110. The valve liner 300 includes a liner body 210 and a liner flange 212. The liner body 210 is disposed in the valve bore 116 and in contact with the cylinder wall 114. The liner flange 212 is formed at an end of the liner body 210. The liner flange 212 is in contact to the compressor cylinder 110. The liner body 210 includes a liner window 214 formed in the liner body 210. The liner window 214 aligns with the cage window 204. The liner body 210 and the liner flange 212 may be formed as a single integral piece as illustrated or may be formed as separate pieces as desired. The liner flange 212 may also be attached to the liner body 210. The valve liner 300 has a generally hollow cylindrical shape. The valve liner 300 includes a valve seat 216 coupled to an inner surface of the liner body 210. As illustrated in FIG. 2, the valve seat 216 is formed as part of the valve liner 300. However, other constructions may include a separately formed valve seat 216 that is permanently or removably attached to the valve liner 300. The stacked valve cage 202 and compressor valve 206 are disposed in the liner body 210. The compressor valve 206 is in contact to the valve seat 216.

At the inlet, the liner body 210 is in fluid communication with the fluid inlet passage 120 to enable gas fluid to enter the valve cage 202 through the cage window 204 and the liner window 214. The gas fluid then flows to the compressor valve 206. At discharge, the liner body 210 is in fluid communication with the fluid discharge passage 122 to discharge gas fluid from the valve cage 202 through the cage window 204 and the liner window 214.

The compressor valve assembly 200 includes a valve cover 218. The valve cover 218 is coupled to the valve cage 202 to apply a bias force during operation of the reciprocating compressor 100 to retain the compressor valve 206 on the valve seat 216. In the illustrated construction, studs 220 extending through the valve cover 218 into the compressor cylinder 110 apply the biasing force with other constructions employing other fasteners or arrangements. The illustrated valve cover 218 is not in direct contact to the liner flange 212. A gap 228 exists between the valve cover 218 and the liner flange 212. It is understood that the valve cover 218 may be disposed in direct contact with the liner flange 212.

The compressor valve assembly 200 includes a pin 222. The pin 222 is disposed at the interface between the liner flange 212 and the compressor cylinder 110 to maintain circumferential alignment between the liner window 214 and the cage window 204 during operation of the reciprocating compressor 100.

The compressor valve assembly 200 includes a seal 224 disposed between the liner body 210 and the cylinder wall 114 to reduce gas fluid leakage therebetween. The compressor valve assembly 200 may include more than one seal 224. As shown in FIG. 2, a first seal 224 is disposed on one end of the liner body 210. A second seal 224 is disposed on the other end of the liner body 210. The compressor valve assembly 200 may include a third seal 224 disposed on an end of the liner body 210 toward the cylinder bore 112. A screw 226 extends in an end surface of liner body 210 for installing a seal 224. The seal 224 may include any seals known in the industry, such as O-ring seal, AccuSeal®, etc.

Figure 3:
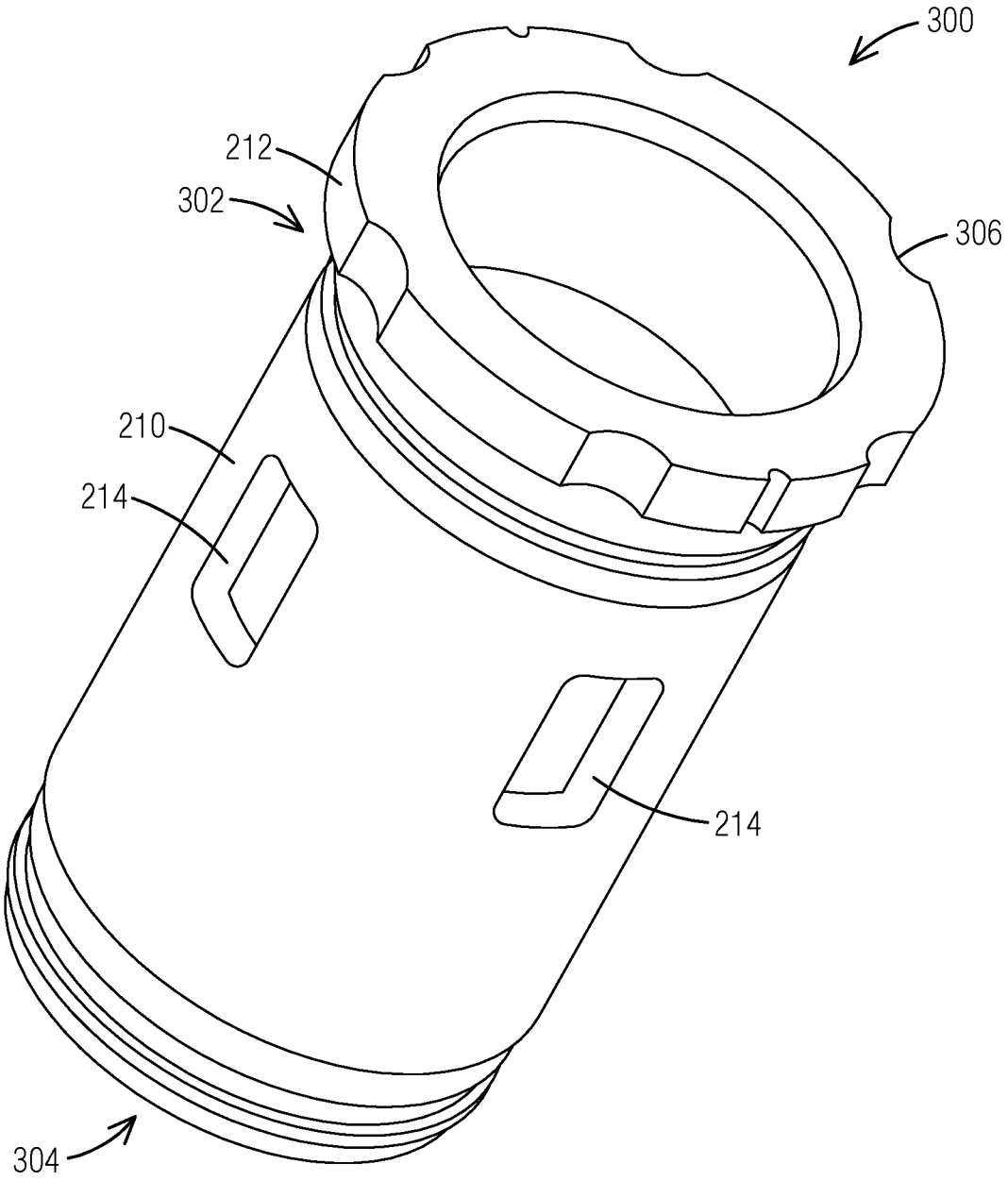
FIG. 3 illustrates a schematic perspective view of a valve liner for use with the compressor valve assembly of FIG. 2.

FIG. 3 illustrates a schematic perspective view of the valve liner 300. The valve liner 300 has a generally hollow cylindrical shape. The valve liner 300 includes the liner body 210 and the liner flange 212. The liner body 210 has a first end 302 and a second end 304. The liner flange 212 is formed at an end of the liner body 210. As illustrated in FIG. 3, the liner flange 212 is formed at the first end 302 of the liner body 210. The liner body 210 includes the liner window 214 cutting through the liner body 210. The liner body 210 may include more than one liner window 214. Each liner window 214 is circumferentially aligned with each cage window 204 once assembled in the compressor cylinder 110 to allow gas fluid passing through the valve cage 202 and the valve liner 300. The liner body 210 and the liner flange 212 may be formed as a single integral piece. The liner flange 212 may also be attached to the liner body 210. The liner flange 212 may have indentations 306 at an outer surface of the liner flange 212.

The valve liner 300 is made from high strength materials to withstand a substantial magnitude of a bias force during operation of the reciprocating compressor 100. The materials of the valve liner 300 may also have high corrosion resistance properties. For example, the materials of the valve liner 300 may include, nodular iron, alloy steel, stainless steel, INCONEL®, etc.

Figure 4:
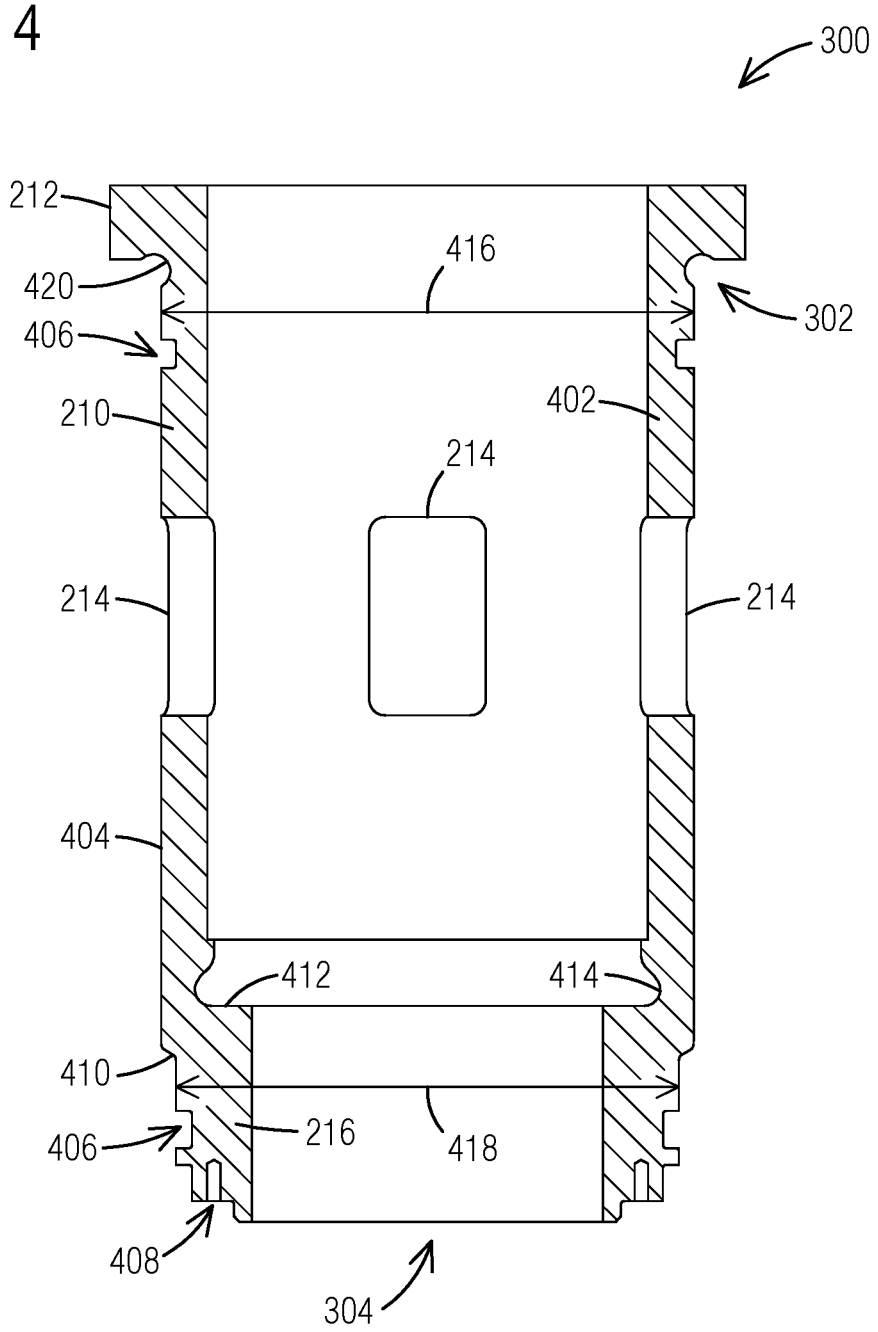
FIG. 4 illustrates a schematic cross-section view of the valve liner of FIG. 3.

FIG. 4 illustrates a schematic cross-section view of the valve liner 300 as shown in FIG. 3. The liner body 210 has an inner surface 402 and an outer surface 404. The liner body 210 includes a groove 406. The groove 406 is formed on the liner body 210 having the opening at the outer surface 404. The liner body 210 may include more than one groove 406. The groove 406 is formed for receiving the seal 224, for example, an O-ring seal. As illustrated in FIG. 4, a first groove 406 is formed on the liner body 210 at a location near the first end 302 for receiving a first seal 224. A second groove 406 is formed on the liner body 210 at a location near the second end 304 for receiving a second seal 224. The liner body 210 includes an aperture 408 formed at an end surface of the second end 304. The screw 226 extends into the aperture 408 for receiving a third seal 224, for example, an AccuSeal®, once assembled in the compressor cylinder 110.

The liner body 210 includes a valve seat 216 coupled to the inner surface 402. The valve seat 216 extends from the inner surface 402 towards a center of the valve liner 300. The valve seat 216 extends to the second end 304. A seating surface 412 is formed at an end surface of the valve seat 216. Thickness of the liner body 210 between the seating surface 412 and the second end 304 is larger than thickness of the liner body 210 between the first end 302 and the seating surface 412. The stacked valve cage 202 and compressor valve 206 are disposed in the liner body 210. The compressor valve 206 is positioned on the seating surface 412 of the valve seat 216. A corner 414 is formed between the inner surface 402 and the seating surface 412. The corner 414 has a curved shape to reduce stress concentration at an area of the corner 414.

The liner body 210 includes a step 410 formed between the seating surface 412 and the second end 304. The step 410 extends from the outer surface 404 towards the inner surface 402. The liner body 210 has a first outermost diameter 416 between the first end 302 and the step 410. The liner body 210 has a second outermost diameter 418 between the step 410 and the second end 304. The first outermost diameter 416 is uniform. The second outermost diameter 418 is uniform. The first outermost diameter 416 is larger than the second outermost diameter 418.

A corner 420 is formed between the liner flange 212 and the outer surface 404 of the liner body 210. The corner 420 has a curved shape to reduce stress concentration at an area of the corner 420.

Figure 5:
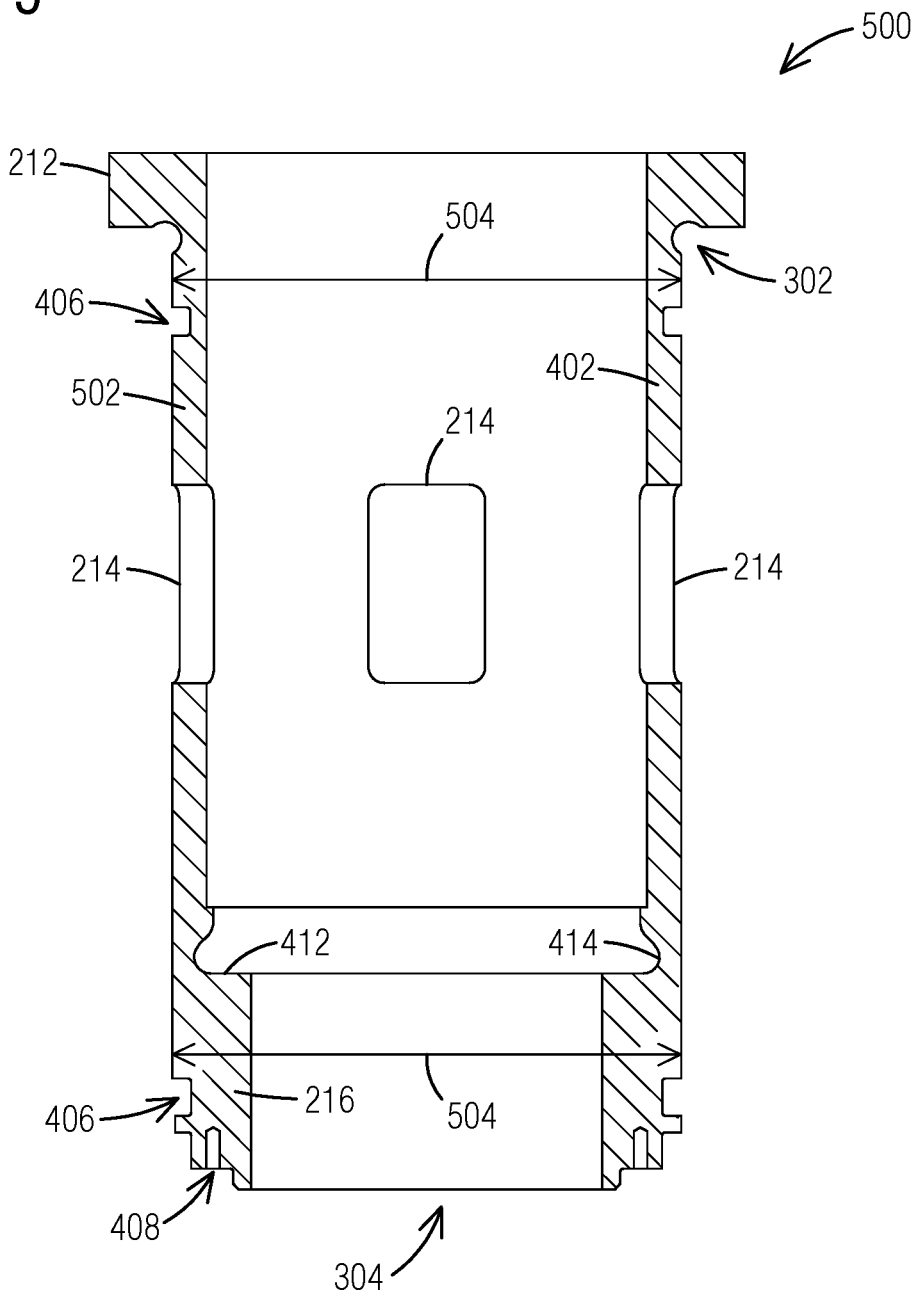
FIG. 5 illustrates a schematic cross-section view of another valve liner.

FIG. 5 illustrates a schematic cross-section view of another valve liner 500 that includes a liner body 502. The liner body 502 has a uniform outermost diameter 504 between the first end 302 and the second end 304. Configuration of the valve liner 500 is otherwise the same as the valve liner 300 and is not described in detail with regard to FIG. 5.

Figure 6:
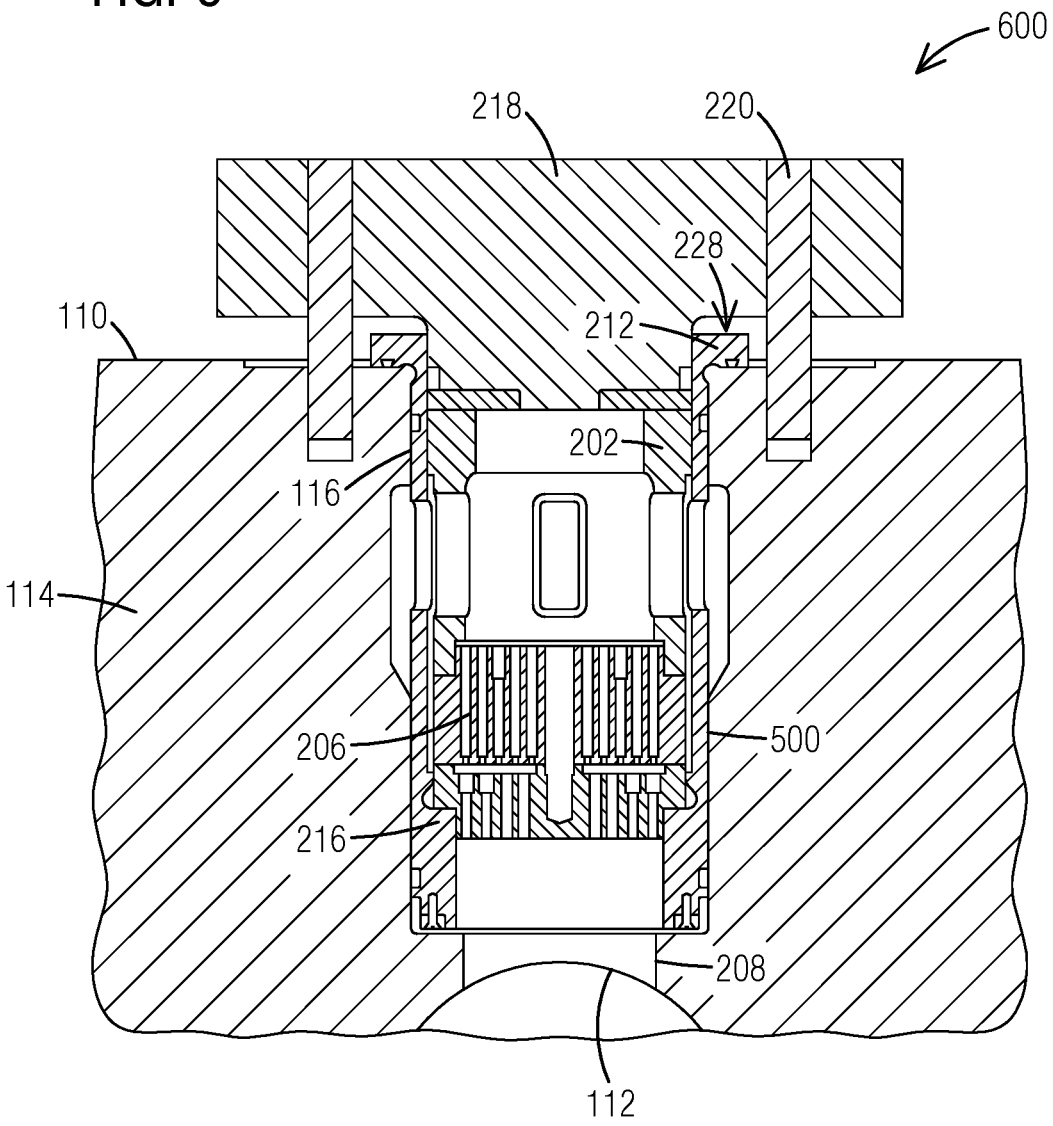
FIG. 6 illustrates a schematic section view of another compressor valve assembly for use of the valve liner of FIG. 5.

FIG. 6 illustrates a schematic end view of another compressor valve assembly 600 assembled in a compressor cylinder 110 of a reciprocating compressor 100 The valve liner 500 as described in FIG. 5 is disposed in the valve bore 116. The stacked valve cage 202 and compressor valve 206 are disposed in the liner body 502. The compressor valve 206 is positioned on the seating surface 412 of the valve seat 216.

Figure 7:
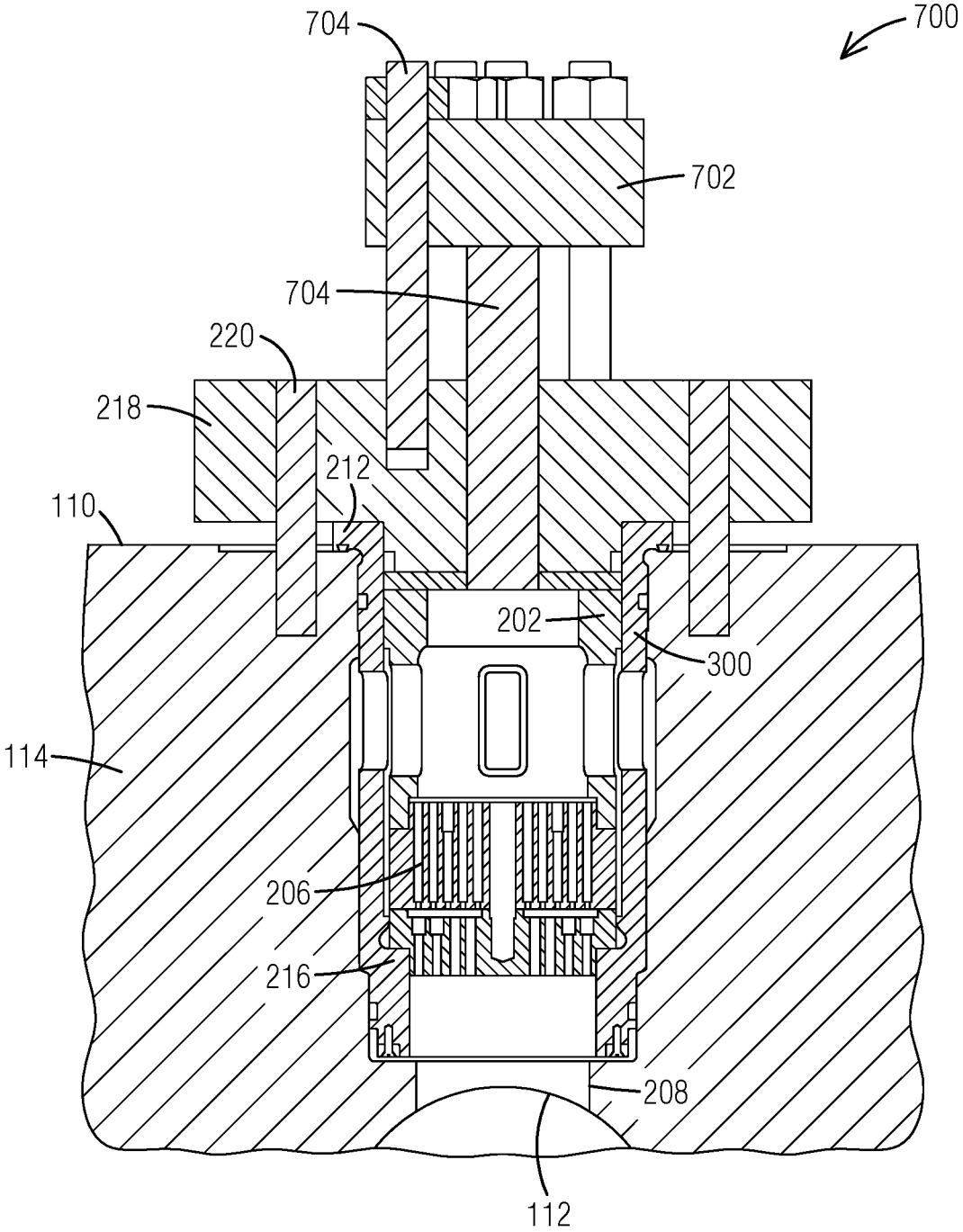
FIG. 7 illustrates a schematic section view of yet another compressor valve assembly for use with the reciprocating compressor of FIG. 1.

FIG. 7 illustrates a schematic end view of yet another compressor valve assembly 700 assembled in a compressor cylinder 110 of a reciprocating compressor 100. The compressor valve assembly 700 includes the valve cover 218. The valve cover 218 is disposed in direct contact with the liner flange 212. The studs 220 extend through the valve cover 218 into the cylinder wall 114. The compressor valve assembly 700 includes a further valve cover 702. Further studs 704 extend through the further valve cover 702 into the valve cover 218. The further valve cover 702 and the further studs 704 provide further bias force to retain the compressor valve 206 on the valve seat 216 and retain the valve liner 300 in the compressor cylinder 110.

According to an aspect, the proposed reciprocating compressor 100 includes a valve liner 300 or a valve liner 500 disposed in the compressor cylinder 110. The valve liner 300 and valve liner 500 have a valve seat 216. The stacked valve cage 202 and compressor valve 206 are positioned on the valve seat 216 of the valve liner 300 or valve liner 500, rather than on the compressor cylinder 110.

In operation of the reciprocating compressor 100, a substantial magnitude of a bias force is generally required from the valve cover 218 to retain the compressor valve 206 on the seating surface 412 of the valve seat 216. This substantial magnitude of bias force can lead to highly concentrated mechanical stress and pressure on the seating surface 412 of the valve seat 216. For example, in certain operation conditions, the pressure can reach 10,000 psi (68,948 kPa) and higher. The seating surface 412 of the valve seat 216 may become damaged through wear and tear.

By providing the valve seat 216 on the valve liner 300 or valve liner 500, rather than on the compressor cylinder 110, the substantial force is applied on the seating surface 412 of the valve seat 216 of the valve liner 300 or valve liner 500. In maintenance, the valve liner 300 or valve liner 500 is replaceable. The valve liner 300 or valve liner 500 may also be replaceable to different configurations to adapt design changes of the compressor valve assembly 200, rather than modifying the compressor cylinder 110. The proposed reciprocating compressor 100 is cost effective and reliable.

Although various embodiments that incorporate disclosed concepts have been shown and described in detail herein, those skilled in the art can readily devise many other varied embodiments that still incorporate these disclosed concepts. Disclosed embodiments are not limited to the specific details of construction and the arrangement of components set forth in the description or illustrated in the drawings. Disclosed concepts may be implemented by other implementations, and of being practiced or of being carried out in various ways, which now would become apparent to one skilled in the art.

None of the description in the present application should be read as implying that any particular element, step, act, or function is an essential element, which must be included in the claim scope: the scope of patented subject matter is defined only by the allowed claims. Moreover, none of these claims are intended to invoke a means plus function claim construction unless the exact words "means for" are followed by a participle.

What is claimed is:

1. A reciprocating compressor comprising:
a compressor cylinder defining a cylinder wall;
a valve bore formed in the cylinder wall;
a compressor valve assembly arranged in the compressor cylinder, the compressor valve assembly comprising:
a valve liner comprising a liner body and a liner flange disposed at a first end of the liner body, the liner body disposed in the valve bore and comprising a liner window, the liner flange positioned in contact with a surface of the compressor cylinder, a valve seat coupled to an inner surface of the liner body, the valve seat comprising a seating surface formed at an end of the valve seat;
a compressor valve positioned on the seating surface of the valve seat;
a valve cage positioned on the compressor valve, the valve cage comprising a cage window;
a valve cover coupled to the valve cage to apply a bias force to retain the compressor valve on the seating surface of the valve seat; and
wherein the surface of the compressor cylinder in contact with the liner flange is perpendicular to the valve bore.

2. The reciprocating compressor of claim 1, further comprising a pin disposed between the liner flange and the compressor cylinder to align the liner window with the cage window.

3. The reciprocating compressor of claim 1, wherein the liner body comprises a uniform outermost diameter between the first end and a second end of the liner body.

4. The reciprocating compressor of claim 1, wherein the liner body comprises a step extending from an outer surface of the liner body towards the inner surface and between the seating surface and a second end of the liner body, wherein a first outermost diameter of the liner body between the first end and the step is larger than a second outermost diameter of the liner body between the step and the second end.

5. The reciprocating compressor of claim 1, further comprising a seal disposed between the cylinder wall and an outer surface of the liner body.

6. The reciprocating compressor of claim 1, wherein the liner body comprises a groove having an opening at an outer surface of the liner body.

7. The reciprocating compressor of claim 1, wherein the liner body comprises an aperture formed at an end surface of a second end of the liner body.

8. The reciprocating compressor of claim 1, wherein a gap exists between the valve cover and the liner flange.

9. The reciprocating compressor of claim 1, wherein the valve cover is disposed in direct contact with the liner flange.

10. The reciprocating compressor of claim 1, further comprising a further valve cover coupled to the valve cover to apply a further bias force to retain the compressor valve on the seating surface of the valve seat.

11. A method for assembling a reciprocating compressor comprising a compressor cylinder, the method comprising:
positioning a valve liner in a valve bore formed in a cylinder wall of the compressor cylinder, the valve liner comprising a liner body, a liner window formed in the liner body, a valve seat coupled to an inner surface of the liner body, and a liner flange disposed at a first end of the liner body, the liner flange in contact with a surface of the compressor cylinder, the valve seat comprising a seating surface formed at an end of the valve seat;
installing a compressor valve in the liner body, the compressor valve in contact with the seating surface of the valve seat;
positioning a valve cage on the compressor valve, the valve cage comprising a cage window;
circumferentially aligning the cage window with the liner window;
coupling a valve cover to the valve cage to apply a bias force to retain the compressor valve on the seating surface of the valve seat; and
wherein the surface of the compressor cylinder in contact with the liner flange is perpendicular to the valve bore.

12. The method of claim 11, further comprising disposing a pin between the liner flange and the compressor cylinder to maintain circumferential alignment between the liner window and the cage window.

13. The method of claim 11, further comprising forming a uniform outermost diameter of the liner body between the first end and a second end of the liner body.

14. The method of claim 11, furthering comprising forming a step on the liner body extending from an outer surface of the liner body towards the inner surface and between the seating surface and a second end of the liner body, wherein a first outermost diameter between the first end and the step is larger than a second outermost diameter between the step and the second end.

15. The method of claim 11, further comprising disposing a seal between the cylinder wall and an outer surface of the liner body.

16. The method of claim 11, further comprising forming a groove on the liner body, wherein an opening of the groove is formed at an outer surface of the liner body.

17. The method of claim 11, further comprising forming an aperture at an end surface of a second end of the liner body.

18. The method of claim 11, further comprising disposing the valve cover at a location having a gap to the liner flange.

19. The method of claim 11, further comprising disposing the valve cover in direct contact with the liner flange.

20. The method of claim 11, further comprising disposing a further valve cover coupled to the valve cover to apply a further bias force to retain the compressor valve on the seating surface of the valve seat.

21. A compressor valve assembly to be arranged in a compressor cylinder of a reciprocating compressor, the compressor valve assembly comprising:

a valve liner comprising a liner body and a liner flange disposed at a first end of the liner body, the liner body comprising a liner window, a valve seat coupled to an inner surface of the liner body, the valve seat comprising a seating surface formed at an end of the valve seat;

a compressor valve positioned on the seating surface of the valve seat;

a valve cage positioned on the compressor valve, the valve cage comprising a cage window;

a valve cover coupled to the valve cage to apply a bias force to retain the compressor valve on the seating surface of the valve seat;

wherein the liner flange is perpendicular to the liner body.

22. The compressor valve assembly of claim 21, wherein the liner body comprises a uniform outermost diameter between the first end and a second end of the liner body.

23. The compressor valve assembly of claim 21, wherein the liner body comprises a step extending from an outer surface of the liner body towards the inner surface and between the seating surface and a second end of the liner body, wherein a first outermost diameter of the liner body between the first end and the step is larger than a second outermost diameter of the liner body between the step and the second end.

24. The compressor valve assembly of claim 21, further comprising a seal disposed on the liner body.

25. The compressor valve assembly of claim 21, wherein the liner body comprises a groove having an opening at an outer surface of the liner body.

26. The compressor valve assembly of claim 21, wherein the liner body comprises an aperture formed at an end surface of a second end of the liner body.

* * * * *